US011592164B2

(12) United States Patent
Jiang

(10) Patent No.: US 11,592,164 B2
(45) Date of Patent: Feb. 28, 2023

(54) LIGHT FIXTURE CAPABLE OF AVOIDING LIGHTING AUTOMATICALLY IN POWER OFF

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/589,196

(22) Filed: Jan. 31, 2022

(65) Prior Publication Data

US 2022/0146083 A1 May 12, 2022

Related U.S. Application Data

(63) Continuation of application No. PCT/CN2021/074044, filed on Jan. 28, 2021.

(30) Foreign Application Priority Data

Oct. 30, 2020 (CN) ..... 202022470464.2

(51) Int. Cl.
*F21V 21/15* (2006.01)
*F21V 23/04* (2006.01)
*F21W 131/406* (2006.01)

(52) U.S. Cl.
CPC ..... *F21V 21/15* (2013.01); *F21V 23/04* (2013.01); *F21W 2131/406* (2013.01)

(58) Field of Classification Search
CPC ..... F21V 21/15; F21V 23/04; F21V 21/06; F21V 21/14; F21V 21/00;
(Continued)

(56) References Cited

U.S. PATENT DOCUMENTS 6,866,402 B2 * 3/2005 Belliveau ..... F21V 21/15 362/85
10,969,087 B1 * 4/2021 Jiang ..... H05B 47/175
(Continued)

FOREIGN PATENT DOCUMENTS

CN 108591863 A 9/2018
CN 109519892 A 3/2019
(Continued)

*Primary Examiner* — Bao Q Truong
(74) *Attorney, Agent, or Firm* — Muncy, Geissler, Olds & Lowe, P.C.

(57) ABSTRACT

A stage light fixture capable of avoiding lighting in power off includes a light head, a brake motor, an auxiliary power supply, and a controller. The controller is configured to control the brake motor to drive the light head to move to a light-avoiding angle at which strong lighting cannot directly shining into a lighting outlet of the light head and perform power-off processing on the brake motor when the brake motor is switched to be powered by the auxiliary power supply. When the stage light fixture is suddenly powered off, the auxiliary power supply will supply power to the brake motor, and the controller enables a motor unit of the brake motor to drive the light head to move to the light-avoiding angle so as to avoid heat damage to the components inside the light head due to strong lighting irradiation.

15 Claims, 5 Drawing Sheets

(58) Field of Classification Search
CPC ..... F21W 2131/406; H02M 3/1582; H02M 3/158; H05B 47/175
See application file for complete search history.

(56) References Cited

U.S. PATENT DOCUMENTS

| | | | | |
|---|---|---|---|---|
| 2013/0120984 | A1* | 5/2013 | Hinrichs | F21V 21/14 362/235 |
| 2014/0009949 | A1* | 1/2014 | Evans | F21V 21/15 362/386 |
| 2018/0292069 | A1* | 10/2018 | Callahan | H01B 9/006 |

FOREIGN PATENT DOCUMENTS

| | | | |
|---|---|---|---|
| CN | 109724035 | A | 5/2019 |
| CN | 209309873 | U | 8/2019 |
| CN | 210831581 | U | 6/2020 |

* cited by examiner

LIGHT FIXTURE CAPABLE OF AVOIDING LIGHTING AUTOMATICALLY IN POWER OFF

CROSS REFERENCE TO RELATED APPLICATIONS

The present application is a continuation of International Application No. PCT/CN2021/074044, filed on Jan. 28, 2021, which claims priority from Chinese Patent Application No. 202022470464.2 filed on Oct. 30, 2020, all of which are hereby incorporated herein by reference.

TECHNICAL FIELD

The present invention relates to the technical field of stage light fixtures, and more particularly, relates to a light fixture capable of avoiding lighting automatically in power off.

BACKGROUND ART

A light head of a stage light fixture generally includes a light source for emitting light beams, a light shield for producing effects, a pattern wheel, a color wheel, and a lens system for projecting light spots. When the stage light fixture is in work, a heat dissipation system inside the light head will work at full capacity to avoid excessive temperature and heat damage to the components in the light head, such as the light source, the light shield, the pattern wheel, a color wheel, etc. However, when the stage light fixture stops working, a lighting outlet of the light head may face strong lighting under the action of gravity, the strong lighting in the external environment thus may be focused on the light source, the light shield, the pattern wheel or the color wheel by the lens system. Especially when the stage light fixture is placed horizontally, due to the heavy tail portion of the light head, the lighting outlet of the light head will face upwards, the components in the head are thus easier to suffer from strong lighting irradiation. However, at this moment, the heat dissipation system in the stage light fixture is not running, resulting in high temperature of the light source, the light shield, the pattern wheel or the color wheel, which may cause heat damage of these components.

SUMMARY

The present invention provides a stage light fixture capable of avoiding lighting in power off, which can automatically adjust to a lighting-avoiding angle to prevent components in the light head from heat damage due to strong lighting irradiation, when the stage light fixture is powered off. In the present invention, a motor unit is braked by a brake unit for power-off braking to maintain it at the lighting-avoiding angle, so that an auxiliary power supply is not required to continuously supply power to a brake motor.

According to the present invention, the stage light fixture includes a light head, a brake motor, an auxiliary power supply, and a controller. The controller is configured to control the brake motor to drive the light head to move to a lighting-avoiding angle at which strong lighting cannot directly enter a lighting outlet of the light head and performs power-off processing on the brake motor when the brake motor is switched to be powered by the auxiliary power supply. The brake motor includes a motor unit for driving the light head and a brake unit for braking the motor unit after power is off.

In the present invention, when the stage light fixture is suddenly powered off, the auxiliary power supply will supply power to the brake motor, and the controller enables the motor unit of the brake motor to drive the light head to move to the lighting-avoiding angle so as to avoid heat damage to the components inside the light head due to strong lighting irradiation. The controller then enables the brake unit of the brake motor to be powered off, the motor unit is accordingly braked, the light head thus remains at the lighting-avoiding angle. the auxiliary power supply thus is not required to continuously supply power to the brake motor, which reduces electricity demand of the auxiliary power supply.

The stage light fixture further has an input unit which is configured to control power on-off between the auxiliary power supply and the brake unit. The controller controls the auxiliary power supply to be connected or disconnected according to a control signal received from the input unit. After the stage light fixture is dismounted, the auxiliary power supply can be controlled by the input unit to supply power to the brake unit so as to unlock the light head, so that the light head can be manually moved or rotated to an ideal position. After the light head moves to the ideal position, the auxiliary power supply is further controlled by the input unit to power off the brake unit again, and the light head is automatically locked. Such design makes it very convenient to move or rotate the light head freely both when the stage light fixture is in disassembly and maintenance with power off.

According to the present invention, the input unit can be a button which is designed in a way that the auxiliary power supply is connected when the button is pressed and the auxiliary power supply is disconnected when the button is released. The button can also be designed in a way that the auxiliary power supply is connected when the button is pressed for the first time and the auxiliary power supply is disconnected when the button is released when being pressed again. Such design is simple in operation, and is convenient to control the auxiliary power supply to be connected or disconnected, which is even possible to rapidly search for the input unit by touch.

The input unit can also be designed in a form of a touch control screen, which is powered by the auxiliary power supply. After the stage light fixture is powered off, the auxiliary power supply automatically supplies power to the touch control screen. The touch control screen is used to control the auxiliary power supply to connect or disconnect a circuit except the touch control screen, so that additional control switch is not required, which can be achieved directly by using an existing control screen on the stage light fixture, with low cost.

According the present invention, the brake unit performs braking in a magnetic attraction mode. When power is on, an electromagnetic coil is used to attract a permanent magnet to unlock the motor unit. When power is off, the electromagnetic coil automatically releases the permanent magnet, and the permanent magnet attracts a brake disc so that the motor unit is locked.

The stage light fixture according to the present invention further provides a gravity sensor for detecting an angle of the light head. As a novel sensor technology, the gravity sensor uses an elastic sensitive element to make a cantilever-type shifter, and drives an electrical contact with an energy storage spring made from an elastic sensitive element to complete conversion from a change of gravity to an electrical signal. During the daytime, the sun shines down from the sky, and since a direction of gravity is also downward, the stage light fixture can preferably adjust the angle of the light head by means of a gravity sensor if it is often used outdoors, which avoids sunlight directly shining into the lighting outlet of the light head.

The light head in the present invention is pivoted to a supporting arm capable of rotating about a first axis, while the supporting arm is pivoted to a light base capable of rotating about a second axis, and the gravity sensor is fixed to the light head or the light base. As known, the stage light fixture is generally fixedly mounted via the light base. There are complicated and diverse mounting methods of the stage light fixture, such as being hung upside down, being hung sideward, and also being placed horizontally. When the gravity sensor is fixed to the light head, the angle of the light head can be directly obtained via the gravity sensor directly, which can achieve a more accurate measurement result. Moreover, a mounting position of the stage light fixture can be calculated by using the angle of the light head when the stage light fixture is reset, an intersection angle between the first axis and the second axis, a rotation angle of a driving mechanism of the supporting arm and a rotation angle of a driving mechanism of the light head at this moment. Since the intersection angle between the first axis and the second axis is generally 90 degrees, a minimum angle between a lighting output direction of the light head and the direction of gravity can be calculated, so that the light head moves directly to a corresponding position without collision at a limiting position. On the other hand, if the gravity sensor is fixed to the light base, the controller detects a mounting position of the stage light fixture via the gravity sensor to determine whether the stage light fixture is hung upside down, hung sideward or placed horizontally, or even a specific mounting angle, and in combination with the intersection angle of the first axis and the second axis, and the rotation angle of the driving mechanism of the supporting arm and the rotation angle of the driving mechanism of the light head, the angle of the light head can be calculated. The gravity sensor is mounted in the light base, a position thereof is relatively fixed, which can obtain more accurate sensing, and the controller can calculate the minimum angle between the lighting output direction of the light head and the direction of gravity according to the mounting method of the stage light fixture and the intersection angle between the first axis and the second axis, so that the light head moves directly to the corresponding position without collision at the limiting position.

In the present invention, when the light head is at the lighting-avoiding angle, the included angle between the lighting output direction of the light head and the direction of gravity is 0 degree to 45 degrees. If the light head is already at the lighting-avoiding angle when the brake motor is switched to be powered by the auxiliary power supply, no adjustment is needed, or the light head is adjusted to a position where the included angle between the lighting output direction and the direction of gravity is minimum.

The stage light fixture according to the present invention further includes an illumination intensity detector for detecting an illumination intensity of lighting emitted to the lighting outlet of the light head. The illumination intensity of the lighting emitted to the lighting outlet of the light head is directly detected, which is more targeted than the gravity sensor, especially when the components inside the stage light fixture are heated due to non-sunlight, for example, when the stage light fixture is used indoors, lighting of other light fixtures is irradiated to the stage light fixture, or an illumination intensity of lighting diffusely reflected into the stage light fixture is too high. Therefore, an orientation of the light head is configured to be adjusted in real time according to the illumination intensity, an angle which minimizes the illumination intensity at a lighting outlet of the stage light fixture thus can be always selected, which can effectively avoid strong lighting irradiation into a light fixture body. Such adjustment method is more intelligent, which is also adapted to sunlight.

The illumination intensity detector in the present invention is preferably arranged inside the light head, considering that it is finally to prevent components inside the light head from heat damage due to strong lighting irradiation, such as a light source, a light shield, a pattern wheel or a color wheel. In addition, the light head may be irradiated with lighting rays from all directions. Therefore, the configuration of being arranged the illumination intensity detector inside the light head can achieve a more accurate detection result.

DETAILED DESCRIPTION

The accompanying drawings are only for illustrative descriptions and cannot be understood as a limitation to the present patent. In order to better illustrate the present embodiment, some parts of the accompanying drawings may be omitted, enlarged or reduced, and do not represent a size of an actual product; and it is understandable for those skilled in the art that some well-known structures in the accompanying drawings and their descriptions may be omitted. The positional relationships depicted in the accompanying drawings are only for illustrative descriptions and cannot be understood as a limitation to the present patent.

Figure 1:
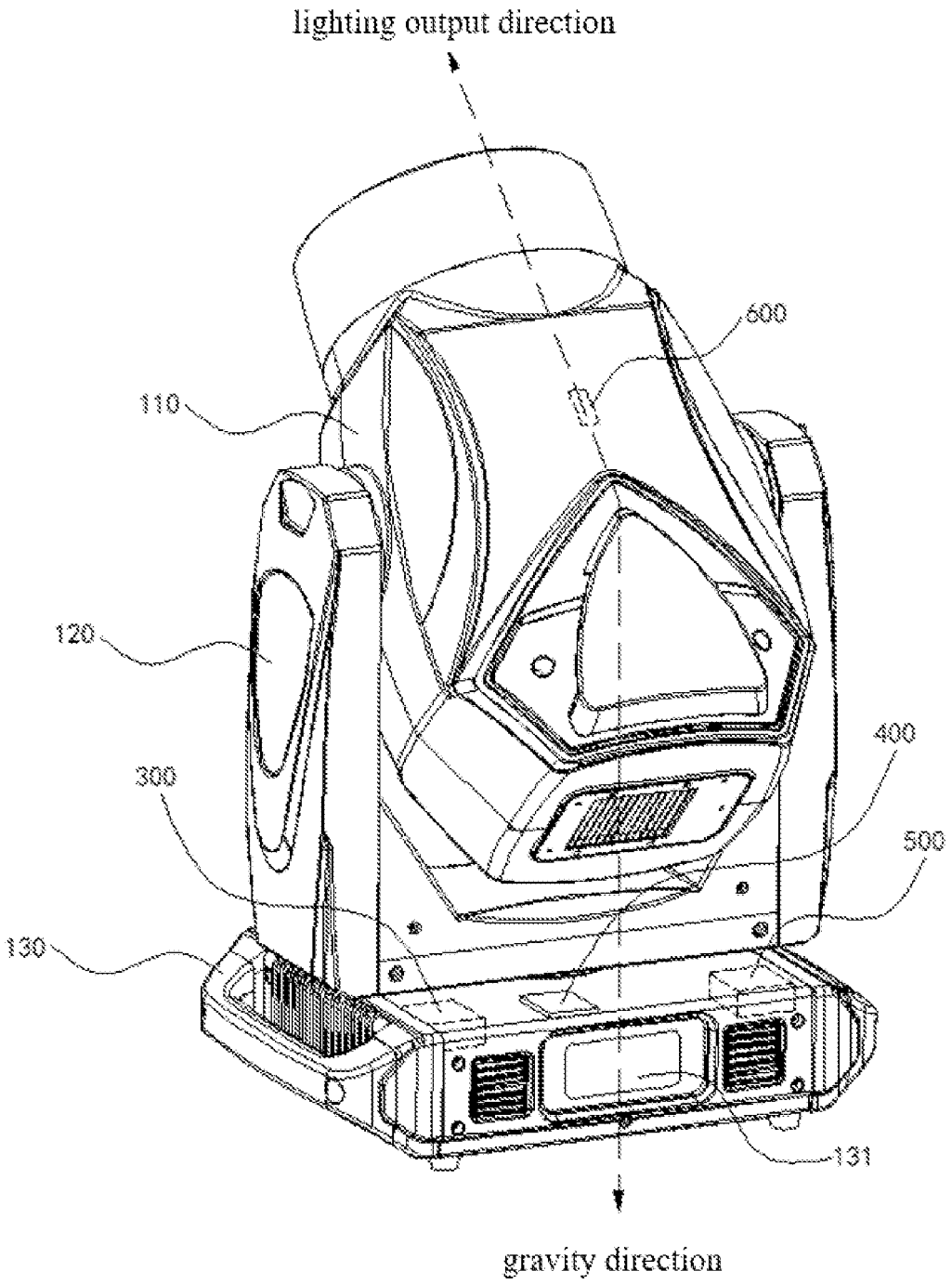
FIG. 1 is a schematic diagram of an overall structure of a stage light fixture according to an embodiment of the present invention.
Figure 2:
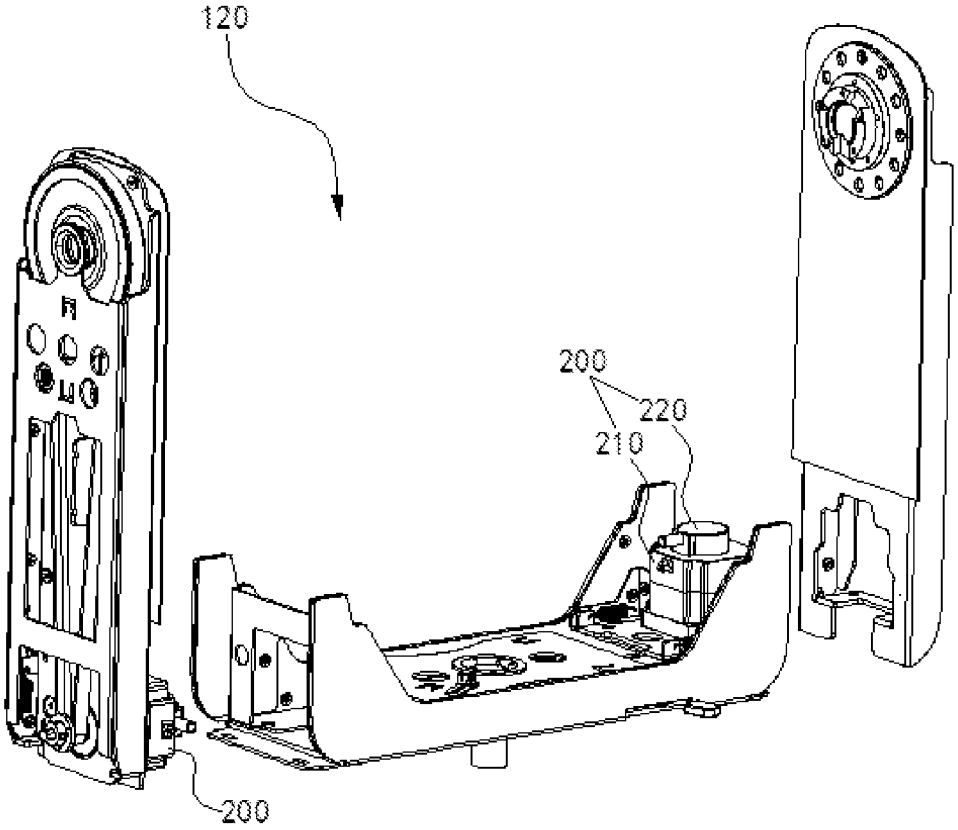
FIG. 2 is a schematic diagram of an internal structure of a supporting arm according to an embodiment of the present invention.
Figure 3:
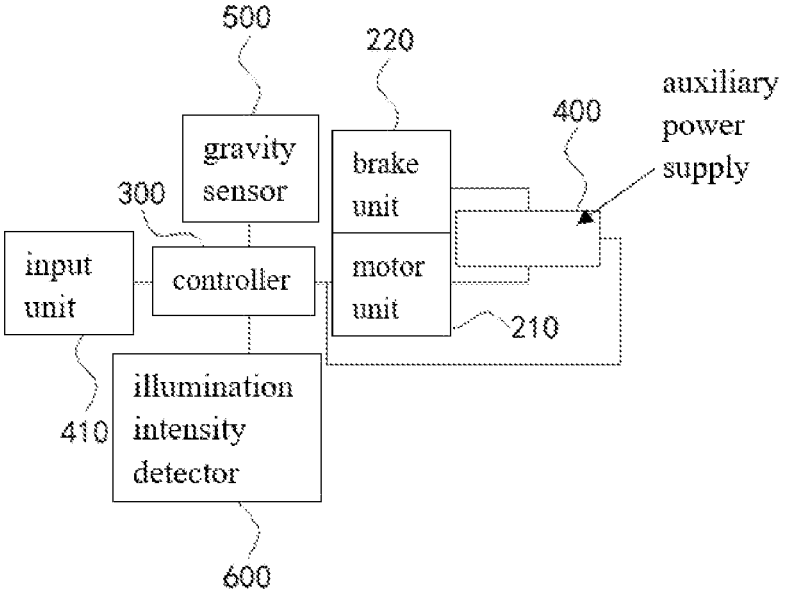
FIG. 3 is a schematic diagram of a control principle of a brake motor according to an embodiment of the present invention.

FIG. 1 to FIG. 3 shows a stage light fixture capable of avoiding lighting in power off according to an embodiment. The stage light fixture includes a light head 110, a brake motor 200 and an auxiliary power supply 400. The stage light fixture further includes a controller 300. The controller 300 is configured to control the brake motor 200 to drive the light head 110 to move to a light-avoiding angle at which strong lighting cannot direct to a lighting outlet of the light head 110 and perform power-off processing on the brake motor 200 when the brake motor 200 is switched to be powered by the auxiliary power supply 400. The brake motor 200 includes a motor unit 210 for driving the light head 100 and a brake unit 220 for braking the motor unit 210 after power is off.

Figure 4:
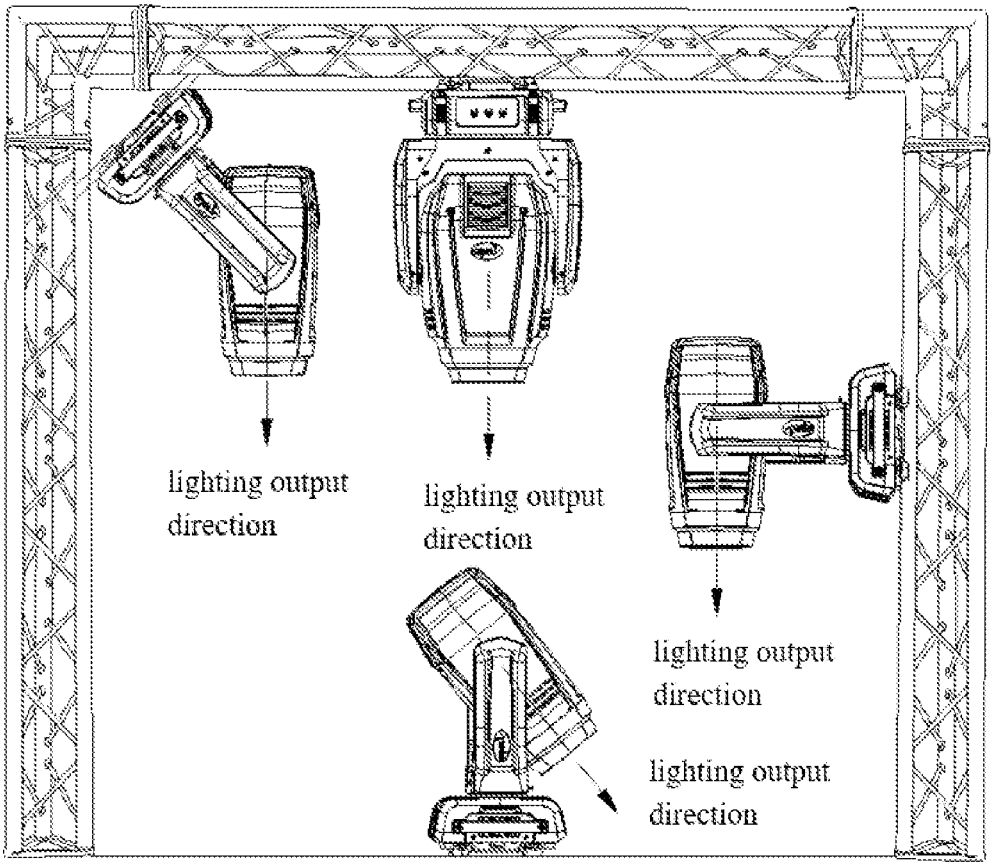
FIG. 4 is a schematic diagram of a mounting method of the stage light fixture according to an embodiment of the present invention.

When the stage light fixture in the present invention is suddenly in power failure, the auxiliary power supply 400 supplies power to the brake motor 200, and the controller 300 controls the motor unit 210 of the brake motor 200 to drive the light head 110 to move to the lighting-avoiding angle (as in FIG. 4) so as to avoid heat damage to the components inside the light head 110 due to strong lighting irradiation. The brake unit 220 of the brake motor 200 is then controlled to be powered off, the motor unit 210 is accordingly braked, the light head 110 thus remains at the lighting-avoiding angle. The auxiliary power supply 400 thus is not required to continuously supply power to the brake motor 200, which reduces electricity demand of the auxiliary power supply 400.

In a preferred embodiment of the present invention, the motor unit 210 and the brake unit 220 are electrically connected to the auxiliary power supply 400 in parallel. The motor unit 210 and the brake unit 220 are independent in power supply of the auxiliary power supply 400.

In a preferred embodiment of the present invention, the brake unit 220 is arranged on one side of the motor unit 210 in a direction perpendicular to a rotation shaft of the motor unit 210. The brake unit 220 can also be arranged around the motor unit 210. Such configuration can reduce a length of the brake motor 200 in a direction of the rotating shaft, taking into account rational utilization of a space in the stage light fixture. If necessary, the brake unit 220 may also be arranged at one end of the motor unit 210 away from the rotating shaft to reduce a width of the brake motor 200.

In a preferred embodiment of the present invention, an input unit 410 is further provided. The input unit 410 is configured to control power on-off between the auxiliary power supply 400 and the brake unit 220. The controller 300 controls the auxiliary power supply 400 to be on and off according to a control signal received from the input unit 410. When the stage light fixture is dismounted, the auxiliary power supply 400 can be controlled by the input unit 410 to supply power to the brake unit 220 so as to unlock the light head 110, so that the light head 110 can be manually moved or rotated to an ideal position. When the light head 110 moves to the ideal position, the auxiliary power supply 400 is further controlled by the input unit 410 to power off the brake unit 220 again, the light head 110 is thus automatically locked. Such configuration makes it very convenient to move or rotate the light head 110 freely both when the stage light fixture is in disassembly and maintenance with powered off. The input unit 410 indirectly controls the auxiliary power supply 400 to be on and off by sending a signal to the controller 300, which is much safer than to directly control it. After the stage light fixture is powered off, the controller 300 is also powered by the auxiliary power supply 400.

According to the present embodiment, the controller 300 and the auxiliary power supply 400 are both arranged in the light base 130, the input unit 410 is located on a housing of the light base 130. In other embodiments, the input unit 410 may also be located on a supporting arm 120 or the light head 110.

In a preferred embodiment of the present invention, the input unit 410 is a button. The auxiliary power supply 400 is connected when the button is pressed and the auxiliary power supply 400 is disconnected when the button is released. Alternatively, the auxiliary power supply 400 is connected when the button is pressed for the first time and the auxiliary power supply 400 is disconnected when the button is released when being pressed again. Such configuration, is simple in operation, and is convenient to control the auxiliary power supply 400 to be connected or disconnected, which is even possible to rapidly search for the input unit 400 by touch.

In a preferred embodiment of the present invention, the input unit 410 is a touch control screen, which is powered by the auxiliary power supply 400. After the stage light fixture is powered off, the auxiliary power supply 400 automatically supplies power to the touch control screen. The touch control screen is used to control the auxiliary power supply 400 to connect or disconnect a circuit except the touch control screen, so that additional control switch is not required, which can be achieved directly by an existing control screen 131 on the stage light fixture, with low cost.

In a preferred embodiment of the present invention, the brake unit 220 performs braking in a magnetic attraction mode. When power is on, an electromagnetic coil is used to attract a permanent magnet to unlock the motor unit 210. When power is off, the electromagnetic coil automatically releases the permanent magnet, and the permanent magnet attracts a brake disc so that the motor unit 210 is locked.

In a preferred embodiment of the present invention, a gravity sensor 500 for detecting an angle of the light head 110 is further provided. As a novel sensor technology, the gravity sensor 500 uses an elastic sensitive element to make a cantilever-type shifter, and drives an electrical contact with an energy storage spring made from an elastic sensitive element to complete conversion from a change of gravity to an electrical signal. During the daytime, the sun shines down from the sky, and since a direction of gravity is also downward, the stage light fixture can preferably adjust the angle of the light head 110 by a gravity sensor if it is often used outdoors, which avoids sunlight directly shining into the lighting outlet of the light head 110.

In a preferred embodiment of the present invention, the light head 110 is pivoted to the supporting arm 120 to rotate about a first axis, the supporting arm 120 is pivoted to a light base 130 to rotate about a second axis, and the gravity sensor 500 is fixed to the light head 110 or the light base 130. The stage light fixture is generally fixedly mounted via the light base 130, and a mounting method of the stage light fixture is complicated and diverse, such as being hung upside down, being hung sideward, and also being placed horizontally (as in FIG. 4). When the gravity sensor 500 is fixed to the light head 110, the angle of the light head 110 can be directly obtained via the gravity sensor 500 directly, achieving a more accurate measurement result. Moreover, a mounting position of the stage light fixture can be calculated by using the angle of the light head 110 when the stage light fixture is reset, an intersection angle between the first axis and the second axis, a rotation angle of a driving mechanism of the supporting arm 120 and a rotation angle of a driving mechanism of the light head 110 at this moment. Since the intersection angle between the first axis and the second axis is generally 90 degrees, a minimum angle between a lighting output direction of the light head 110 and the direction of gravity can be calculated, so that the light head 110 moves directly to a corresponding position without collision at a limiting position. On the other hand, when the gravity sensor 500 is fixed to the light base 130, the controller 300 detects a mounting position of the stage light fixture by the gravity sensor 500 to determine whether the stage light fixture is hung upside down, hung sideward or placed horizontally, or even a specific mounting angle, and in combination with the intersection angle of the first axis and the second axis, and the rotation angle of the driving mechanism of the supporting arm 120 and the rotation angle of the driving mechanism of the light head 110, the angle of the light head 110 can be calculated. The gravity sensor 500 is mounted in the light base 130, the position of the gravity sensor 500 is relatively fixed, which achieves more accurate sensing, and the controller 300 can calculate the minimum angle between the light output direction of the light head 110 and the direction of gravity according to the mounting method of the stage light fixture and the intersection angle between the first axis and the second axis, so that the light head 110 moves directly to the corresponding position without collision at the limiting position.

In the present embodiment, the gravity sensor 500 is fixed to the light head 110.

In a preferred embodiment of the present invention, when the light head 110 is at the lighting-avoiding angle, an included angle between the lighting output direction of the light head 110 and the direction of gravity is 0 degree to 45 degrees. If the light head 110 is already at the lighting-avoiding angle when the brake motor 200 is switched to be powered by the auxiliary power supply 400, no adjustment is needed, or the light head is adjusted to a position where the included angle between the lighting output direction and the direction of gravity is minimum.

In a preferred embodiment of the present invention, an illumination intensity detector 600 is further provided for detecting an illumination intensity of lighting emitted to the lighting outlet of the light head 110. The illumination intensity of the lighting emitted to the lighting outlet of the light head 110 is directly detected, which is more targeted than the gravity sensor 500, especially when components inside the stage light fixture are heated due to non-sunlight, for example, when the stage light fixture is used indoors, lighting of other light fixtures is irradiated to the stage light fixture, or an illumination intensity of lighting diffusely reflected into the stage light fixture is too high. Therefore, an orientation of the light head 110 is configured to be adjusted in real time according to the illumination intensity, an angle which minimizes the illumination intensity at a lighting outlet of the stage light fixture thus can be always selected, which can effectively avoid strong lighting irradiation into a light fixture body. Such adjustment method is more intelligent, which is also adapted to sunlight.

In a preferred embodiment of the present invention, the illumination intensity detector 600 is arranged inside the light head 110, considering that it is finally to prevent components inside the light head 110 from heat damage due to strong lighting irradiation, such as a light source, a light shield, a pattern wheel or a color wheel. In addition, the light head 110 may be irradiated with lighting from all directions, such configuration can avoid receiving stray lighting in other directions, achieving more accurate detection result.

In a preferred embodiment of the present invention, the illumination intensity detector 600 is arranged on a central line of a lighting path of the light source, which is a position where lighting emitted to the lighting outlet of the light head 110 are most easily focused.

In a preferred embodiment of the present invention, a boost circuit is arranged between the auxiliary power supply 400 and the brake unit 220. The boost circuit may boost a voltage of the auxiliary power supply 400 to a voltage value required by the brake unit 220.

When the stage light fixture is connected with a mains supply, the controller 300 would detect whether the light head 110 is currently at the lighting-avoiding angle, if not, the controller 300 controls the motor unit 210 to drive the light head 110 to move to a new lighting-avoiding angle again according to the detection result of the gravity sensor 500 or the illumination intensity detector 600.

In particular, when the gravity sensor 500 is fixed to the light base 130, the stage light fixture is connected with the mains supply, if the controller 300 detects that an angle of the light base 130 is consistent with an angle when the mains supply is cut off in the last time, the light head 110 is directly driven to move to the lighting-avoiding angle after power is off in the last time, without calculating the lighting-avoiding angle again. When the gravity sensor 500 is fixed to the light head 110, if the controller 300 detects that the angle of the light head 110 is consistent with the angle when the mains supply is cut off last time after the stage light fixture is connected with the mains supply, it is only needed that the position of the light head 110 is kept unchanged, and the lighting-avoiding angle does not need to be calculated again, either.

Figure 5:
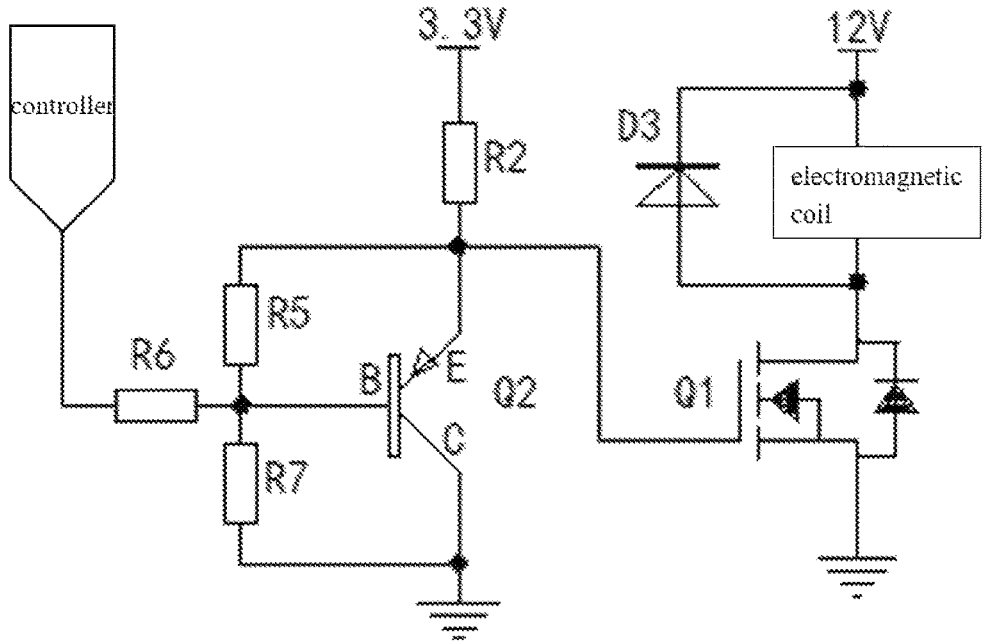
FIG. 5 is a structural schematic diagram of a brake control circuit according to an embodiment of the present invention.

FIG. 5 shows a structural schematic diagram of a brake control circuit according to the present embodiment of the present invention. R2, R6 and R7 are 1KΩ R5 is 10KΩ, D3 is an SK34A model, Q1 is an S12318CDS model, and Q2 is a 2SA1981S-Y model.

Figure 6:
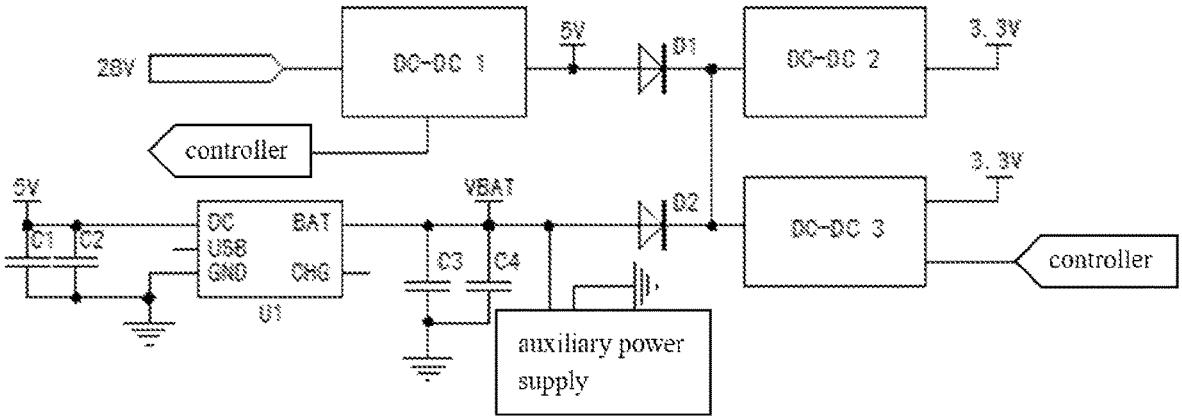
FIG. 6 is a structural schematic diagram of a charging-discharging control circuit of an auxiliary power supply according to an embodiment of the present invention.

FIG. 6 shows a structural schematic diagram of a charging-discharging control circuit of the auxiliary power supply 400 according to the present embodiment of the present invention. C1 and C3 are 1 μF, C2 and C4 are 0.1 μf, D1 and D2 are SK34A models, DC-DC1 converts 28V to 5V, DC-DC2 converts 5V to 3.3V, DC-DC3 converts 5V to 3.3V, U1 is a MAX1555EZK-T model, and the controller 300 is connected to the DC-DC1 to perform power-on detection.

In a preferred embodiment of the present invention, the boost circuit is arranged between the auxiliary power supply 400 and the brake motor 200. The boost circuit may boost the voltage of the auxiliary power supply 400 to the voltage value required by the brake motor 200.

Figure 7:
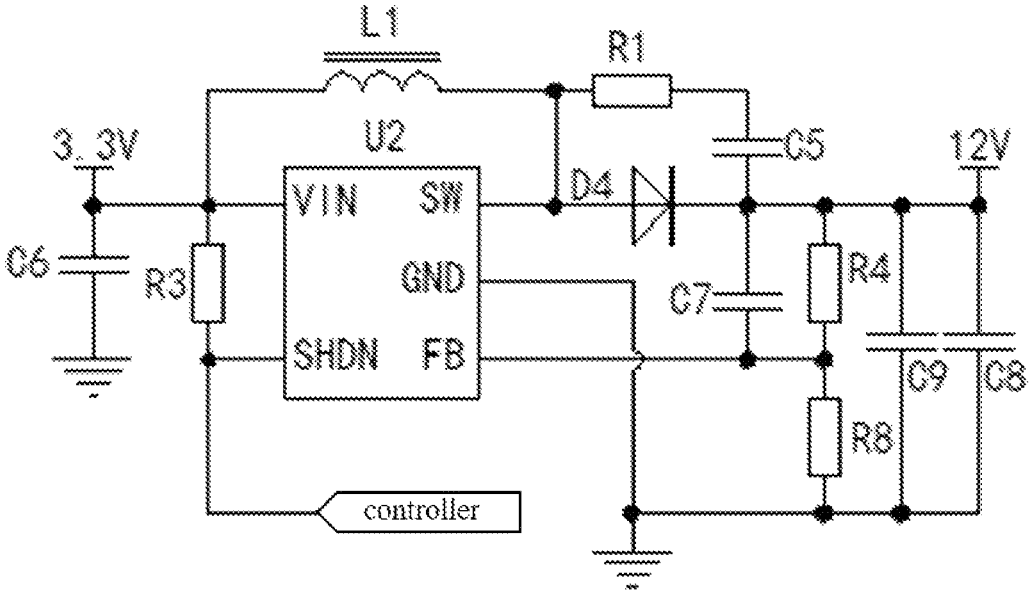
FIG. 7 is a structural schematic diagram of a boost circuit according to an embodiment of the present invention

FIG. 7 shows a structural schematic diagram of the boost circuit of the present invention. R1 is 10Ω, R3 is 47KΩ, R4 is 62KΩ, R8 is 6.8KΩ, C5 is 1 nF, C6 is 10 μF, C7 is 220 pF, C8 is 0.1ρf, C9 is 10 μf, L1 is 10 μH, D4 is an SS14 model, and U2 is an LMR62014 model.

When the stage light fixture is powered off, the auxiliary power supply 400 is discharged, whose voltage is VBAT (for example. 3.7V), and is input via the D2 to the DC-DC2 to be reduced, 3.3V is output for use by the controller 300. When detecting that the DC-DC1 gives out a low level, the controller 300 determines that the mains supply is disconnected, and then gives out a low level to control the DC-DC3 to be closed, at this moment, there is no 3.3V output, the boost circuit and the brake control circuit is in power failure and stops working, entering a dormant power saving mode. The electromagnetic coil loses power and loses magnetic force, the permanent magnet thus attracts the brake disc to realize brake locking.

When it is necessary to temporarily relieve brake locking, a temporary power-on signal is input by the input unit 410, the controller 300 in standby detects the temporary power-on signal, determines that brake is temporarily relieved manually, gives out a high level to control the DC-DC3 to work, and reduces the discharge voltage VBAT of the auxiliary power supply 400 to 3.3V, the controller 300 thus gives out a low-level signal to control the U2 to work. At this moment, the brake control circuit still works, the electromagnetic coil is powered up and generates magnetic force to pull-open the brake disc, and brake is relieved. When a power-off signal is input by the input unit 410, it is determined that temporary relieving of brake locking is completed, and the above-mentioned dormant power-saving mode is entered.

Obviously, the above-mentioned embodiments of the present invention are merely examples to clearly illustrate the present invention, and are not intended to limit the implementation modes of the present invention. For those of ordinary skill in the art, other changes or variations in different forms can also be made since the above description. It is unnecessary and impossible to list all the implementation modes here. Any modification, equivalent replacement, improvement and the like made within the spirit and principle of the present invention shall be included in the protection scope of the claims of the present invention.

The invention claimed is:

1. A stage light fixture capable of avoiding lighting automatically in power off, comprising a light head;

a brake motor, which has a motor unit for driving the light head and a brake unit for braking the motor unit when power is off;

an auxiliary power supply; and a controller, wherein the controller is configured to control the brake motor to drive the light head to move to a light-avoiding angle and perform power-off processing on the brake motor when the brake motor is switched to be powered by the auxiliary power supply.

2. The stage light fixture according to claim 1, further comprising an input unit which is configured to control power on-off between the auxiliary power supply and the brake unit, wherein the controller controls the auxiliary power supply to be connected or disconnected according to a control signal received from the input unit.

3. The stage light fixture according to claim 2, wherein the input unit is designed as a button, which is configured in a way that the auxiliary power supply is connected when the button is pressed and the auxiliary power supply is disconnected when the button is released.

4. The stage light fixture according to claim 2, wherein the input unit is designed as a button, which is configured in a way that the auxiliary power supply is connected when the button is pressed for the first time and the auxiliary power supply is disconnected when the button is released being pressed again.

5. The stage light fixture according to claim 2, wherein the input unit is designed as a touch control screen, and the touch control screen is powered by the auxiliary power supply.

6. The stage light fixture according to claim 1, wherein the brake unit performs braking in a magnetic attraction mode.

7. The stage light fixture according to claim 1, further comprising a gravity sensor which is configured to detect an angle of the light head.

8. The stage light fixture according to claim 7, wherein the light head is pivoted to a supporting arm to rotate about a first axis, the supporting arm is pivoted to a light base to rotate about a second axis, and the gravity sensor is fixed to the light head or the light base.

9. The stage light fixture according to claim 7, wherein when the light head is at the light-avoiding angle, an included angle between a lighting output direction of the light head and a direction of gravity is between 0 degree to 45 degrees.

10. The stage light fixture according to claim 7, wherein when the stage light fixture is connected with a mains supply, the controller detects whether the light head is currently at the lighting-avoiding angle, if not, the controller controls the motor unit to drive the light head to move to a new lighting-avoiding angle again according to a detection result of the gravity sensor.

11. The stage light fixture according to claim 1, further comprising an illumination intensity detector which is configured to detect an illumination intensity of lighting emitted to a lighting outlet of the light head.

12. The stage light fixture according to claim 11, wherein the illumination intensity detector is arranged inside the light head.

13. The stage light fixture according to claim 12, wherein the illumination intensity detector is arranged on a central line of a lighting path of the light source.

14. The stage light fixture according to claim 11, wherein when the stage light fixture is connected with a mains supply, the controller detects whether the light head is currently at the lighting-avoiding angle, if not, the controller controls the motor unit to drive the light head to move to the lighting-avoiding angle again according to a detection result of the illumination intensity detector.

15. The stage light fixture according to claim 1, wherein a boost circuit is arranged between the auxiliary power supply and the brake unit.

* * * * *